US007874380B2

(12) United States Patent
Mocivnik et al.

(10) Patent No.: US 7,874,380 B2
(45) Date of Patent: Jan. 25, 2011

(54) METHOD AND DEVICE FOR DRILLING, PARTICULARLY PERCUSSION OR ROTARY PERCUSSION DRILLING, A HOLE IN SOIL OR ROCK MATERIAL

(75) Inventors: Josef Mocivnik, Fohnsdorf (AT); Alfred Wagner, Linz (AT); Karl Bohm, Holzhausen (AT)

(73) Assignee: "ALWAG" Tunnelausbau Gesellschaft m.b.H., Pasching (AT)

( * ) Notice: Subject to any disclaimer, the term of this patent is extended or adjusted under 35 U.S.C. 154(b) by 140 days.

(21) Appl. No.: 11/921,762

(22) PCT Filed: May 30, 2006

(86) PCT No.: PCT/AT2006/000220

§ 371 (c)(1),
(2), (4) Date: Dec. 7, 2007

(87) PCT Pub. No.: WO2006/130889

PCT Pub. Date: Dec. 14, 2006

(65) Prior Publication Data

US 2009/0114402 A1 May 7, 2009

(30) Foreign Application Priority Data

Jun. 7, 2005 (AT) ..... A 963/2005

(51) Int. Cl.
*E21B 17/10* (2006.01)

(52) U.S. Cl. ..... 175/57; 175/230; 175/40; 175/118; 405/259.3; 405/259.4

(58) Field of Classification Search ..... 175/40, 175/57, 118, 230, 257, 171; 405/259.1, 259.3, 405/259.4
See application file for complete search history.

(56) References Cited

U.S. PATENT DOCUMENTS

| | | | | |
|---|---|---|---|---|
| 3,202,034 | A * | 8/1965 | Korenchan | 411/24 |
| 3,837,258 | A * | 9/1974 | Williams | 405/259.3 |
| 4,310,266 | A | 1/1982 | Malsbury et al. | |
| 4,490,074 | A | 12/1984 | Chaiko | |
| 5,465,535 | A | 11/1995 | Skogberg | |

(Continued)

FOREIGN PATENT DOCUMENTS

| | | |
|---|---|---|
| DE | 2 105 888 | 8/1971 |

(Continued)

OTHER PUBLICATIONS

International Search Report dated Aug. 21, 2006.

*Primary Examiner*—Jennifer H Gay
*Assistant Examiner*—Elizabeth C Gottlieb
(74) *Attorney, Agent, or Firm*—Jacobson Holman PLLC

(57) ABSTRACT

A method and device for drilling, particularly percussion drilling or rotary percussion drilling a hole in soil or rock material and fixing an anchoring in the hole. To this end, a drilled hole is made by a drill bit mounted on a drill rod. The drill rod, on the rear side facing away from the drilling surface of the drill bit, is surrounded at a distance from the drill bit by an anchoring element whose outside dimension exceeds, at least in part, the circumference of the drilled hole made by the drill bit.

10 Claims, 3 Drawing Sheets

U.S. PATENT DOCUMENTS

| | | | | |
|---|---|---|---|---|
| 7,465,128 | B2 * | 12/2008 | Bruneau | 405/259.3 |
| 7,566,189 | B2 * | 7/2009 | Simmons et al. | 405/259.6 |
| 2001/0004025 | A1 | 6/2001 | Mocivnik et al. | |
| 2004/0065475 | A1 * | 4/2004 | Laursen et al. | 175/7 |
| 2007/0269274 | A1 * | 11/2007 | Seedsman | 175/57 |
| 2008/0008553 | A1 * | 1/2008 | Gillis et al. | 411/15 |
| 2008/0260472 | A1 * | 10/2008 | Craig | 405/259.4 |

FOREIGN PATENT DOCUMENTS

| | | |
|---|---|---|
| DE | 26 53 873 | 6/1978 |
| DE | 37 17 024 | 12/1988 |
| EP | 0 241 451 | 7/1991 |
| EP | 0 75 663 | 11/1998 |
| GB | 1 542 541 | 3/1979 |
| WO | WO 98/21439 | 5/1998 |
| WO | WO 98/58132 | 12/1998 |
| WO | WO 02/088523 | 11/2002 |
| WO | WO 2005/085582 | 9/2005 |
| WO | WO 2005/090753 | 9/2005 |

* cited by examiner

METHOD AND DEVICE FOR DRILLING, PARTICULARLY PERCUSSION OR ROTARY PERCUSSION DRILLING, A HOLE IN SOIL OR ROCK MATERIAL

This is a national stage of International Application No. PCT/AT2006/000220 filed on May 30, 2006 and published in German.

FIELD OF THE INVENTION

The present invention relates to a method for drilling, particularly percussion or rotary percussion drilling, a hole in soil or rock material and fixing an anchorage in said hole, wherein a borehole is formed by a drill bit mounted on a drill rod assembly, as well as a device for drilling, particularly percussion or rotary percussion drilling, a hole in soil or rock material and fixing an anchorage in said hole, wherein a borehole is formed by a drill bit mounted on a drill rod assembly.

PRIOR ART

In the context of the production of a hole or borehole in soil or rock material and the subsequent fixation of an anchorage or lining in the borehole, it is, for instance, known from WO 98/21439 and WO 98/58132 to introduce an envelope tube into the borehole during the drilling operation, for instance percussion or rotary percussion drilling, whereupon, after the completion of the bore, part of the drill bit is optionally removed from the borehole together with the drill rod assembly, while the envelope tube remains within the borehole such that an anchor will subsequently be formed in the borehole by filling a curing mass into the same. According to the configuration set out in WO 98/58132, the drill rod assembly may be provided with additional ribs and grooves on its outer periphery so as to ensure an accordingly good anchoring effect in case the drill rod assembly remains within the borehole with subsequent filling.

Alternatively, it is known to remove the drilling tool together with the drill rod assembly from a borehole after the production of the borehole, whereupon an anchor or anchoring means is subsequently introduced into the borehole, wherein embodiments are, for instance, known from EP-B 0 241 451, U.S. Pat. No. 4,490,074, DE-AS 21 05 888, U.S. Pat. No. 4,310,266, EP-A 0 875 663 and other documents, in which the, for instance, pipe-shaped anchorage to be subsequently introduced is held at a diameter reduced relative to the final state by appropriate holding elements before being moved or pressed into abutment on the borehole wall to achieve the desired anchoring effect after having been completely introduced into the borehole. That known prior art, on the one hand, involves the drawback that the borehole has to be made in a first method step, whereupon, after the removal of the drilling tool along with the drill rod assembly, the anchoring device is introduced into the optionally very long borehole in a further method step, after which abutment on the borehole wall is accomplished. It is immediately apparent that the two separate operating steps will not only require an accordingly increased amount of time, but that an optionally subsequent introduction of such an anchoring device having a great length will entail difficulties. Furthermore, it is to be anticipated that the removal of the drilling device together with the drill rod assembly and the subsequent introduction of an anchoring device is only feasible in comparatively solid soil or rock, whereby it must be safeguarded that no material will, for instance, break into the borehole during the drilling operation or after the removal of the drilling tool and prior to the final introduction of the anchoring device, which material would block the borehole and render the introduction of the anchoring device no longer possible.

SUMMARY OF THE INVENTION

The present invention, therefore, aims to provide a method and a device of the initially defined kind, by which it is feasible with structurally simple means to ensure temporary securement already during the drilling operation and a reliable anchorage immediately after the completion of the drilling operation.

To solve these objects, a method of the initially defined kind is essentially characterized in that an anchoring element surrounding the drill rod assembly is introduced into the borehole in a frictionally engaged manner, in particular at a distance from the drill bit, and that the anchoring element is expanded after the completion of the borehole. Due to the fact that, according to the invention, an anchoring element surrounding the drill rod assembly is introduced into the borehole in a frictionally engaged manner, it is ensured that a temporary anchoring effect is achieved by the friction acting between the outer periphery of the anchoring element and the inner periphery of the borehole so as to ensure, at any time, temporary securement of the anchor formed by the anchoring element arranged thereon and by the drill bit. Due to the fact that, according to the invention, the anchoring element is additionally expanded into abutment on the borehole wall after the completion of the borehole, an accordingly safe and reliable anchoring effect will be achieved immediately after the completion of the borehole and, in particular, without any additional steps as opposed to the prior art, which, after the completion of the borehole, involved the removal of the drill rod assembly and the drill bit and the subsequent introduction of an anchor element including anchoring elements provided about its periphery.

For a particularly simple and reliable anchorage of the anchoring element after the completion of the borehole, it is proposed according to a preferred embodiment that the drill rod assembly is retracted in the direction to the anchoring element after the completion of the borehole, and the anchoring element is expanded by an expansion element mounted on the drill rod assembly on the side of the drill bit facing away from the working surface. Due to the fact that the anchoring element, in accordance with the invention, is introduced into the interior of the borehole in a frictionally engaged manner and, hence, secured in its position, it is feasible to retract the drill rod assembly along with the drill bit out of the borehole over a length corresponding to the portion extending between the drill bit and the anchoring element, whereupon the anchoring element, by an expansion element mounted on the drill rod assembly, is expanded and additionally pressed into abutment on the borehole.

In order to determine the anchoring effect, or securing effect, that is achievable by the anchorage of the anchor produced by the drill rod assembly, it is proposed according to a further preferred embodiment that the strength or resistance of the anchorage is checked after the expansion of the anchoring element, in particular, by fixing a checking device to the drill rod assembly on the end projecting out of the borehole. Such a check is feasible in various ways and allows for conclusions to be made as to the obtained anchoring performance and/or the time course or maintenance of the anchoring effect.

If, for instance, due to displacements of soil or rock layers, particularly during continued operations in the vicinity of the produced borehole, shifts in the region of the anchor and hence, as the case may be, a reduced anchoring effect are detected, it is proposed according to a further preferred embodiment that, during or after the detection of a reduced resistance of the anchorage, the drill rod assembly is again powered up for drilling, particularly percussion or rotary percussion drilling, to increase the length of the borehole. It is, thus, possible by the method according to the invention, after having provided an optionally merely temporary anchorage by the expansion of the anchoring element, to continue the drilling operation when detecting an insufficient or eventually weakening anchorage effect, by using the drill rod assembly located in the borehole as well as the drill bit mounted thereon, and drive the bore or borehole more deeply into the soil or rock material in order to enlarge the length of the borehole, particularly upon extension with a suitable additional drill rod assembly element, so as to thereby possibly reach layers providing an enhanced anchoring effect. Due to the fact that the anchoring element is immediately taken along at a distance of the drill bit even when continuing the drilling operation, such an enlargement of the length of the borehole by the anchoring element, which is again introduced into, and in abutment on, the inner wall of the borehole in a frictionally engaged manner, allows for the temporary securement, and subsequently the simple fixation, of the anchoring element by expansion.

In order to achieve a possibly higher anchoring effect or performance upon completion of the continued drilling operation, it is proposed according to a further preferred embodiment that the anchoring element, after an enlargement of the length of the borehole, is expanded to an outer periphery increased relative to that resulting from the first expansion procedure.

To solve the objects mentioned in the beginning, a device of the above-defined kind is, moreover, essentially characterized in that the drill rod assembly, on its rear side facing away from the working surface of the drill bit and, in particular, at a distance from the drill bit, is surrounded by an anchoring element whose external dimension at least partially exceeds the periphery of the borehole produced by the drill bit. As already mentioned above, it is feasible in a simple manner to provide temporary securement within the borehole due to the fact that the anchoring element, whose external dimension at least partially exceeds the periphery of the borehole produced by the drill bit, is introduced into the interior of the borehole during the drilling operation in a substantially frictionally engaged manner.

In order to ensure the reliable introduction into the interior of the borehole without causing excessive forces, of the anchoring element having an external dimension at least partially exceeding the outer periphery of the drill bit, it is proposed according to a preferred embodiment that the anchoring element is formed by a pipe which is, in particular, slotted in the longitudinal direction and/or by a pipe having portions of reduced outer periphery. Such a slotted pipe, or pipe having portions of reduced outer periphery or reduced external dimensions, may be slightly varied in terms of periphery, partially also for adaptation to different geological conditions, wherein it will always be safeguarded that a frictionally engaged abutment will exist, at least over portions, so as to ensure temporary securement of the anchoring element during the production of the borehole.

In order to enable the simple and reliable introduction of the anchoring element having external dimensions at least partially exceeding the outer periphery of the drill bit, it is provided according to a further preferred embodiment that the anchoring element is formed with a bevel on its end facing the drill bit. Such a bevel or taper on the end of the anchoring element facing the drill bit will, in particular, prevent jamming or wedging on the inner wall of the borehole when introducing the anchoring element during the drilling operation.

To enable the simple and reliable expansion of the anchoring element, it is, moreover, proposed that, on the side facing away from the working surface of the drill bit, an expansion element tapering from the drill bit towards the anchoring element is provided, which is capable of being introduced into the expandable anchoring element after the completion of the bore, by a retraction of the drill rod assembly from the borehole, as in correspondence with a further preferred embodiment of the device according to the invention. Such an expansion element tapering towards the anchoring element allows for the simple and reliable entry of the expansion element into the end region of the anchoring element facing the drill bit, whereby the conical taper or expansion, with the progressive entry into the interior of the anchoring element, enables an accordingly progressive expansion of the anchoring element while pressing the same against the inner wall of the borehole.

As already indicated above, it is feasible in the event that, for instance, a reduced anchoring effect is detectable in the course of time, in particular, when carrying out other operations in the immediate vicinity of the borehole, to simply enlarge the length of the borehole by resuming the drilling operation. In this context, it is, in particular, feasible in an accordingly simple manner to remove the expansion element conically tapering towards the anchoring element from the anchoring element during powering-up of the drill rod assembly and subsequently perform or continue the drilling operation via the upstream drill bit.

For the proper and reliable positioning of the anchoring element both during the drilling operation and during the expansion procedure in order to achieve the desired anchoring effect, it is proposed according to a further preferred embodiment that a stop capable of being fixed to the drill rod assembly is provided on the end of the anchoring element facing away from the drill bit. Such a stop capable of being fixed to the drill rod assembly can, for instance, be formed in the manner of a nut or an annular element provided with a thread, which, in the event of a drill rod assembly designed with a thread, can be fixed to the drill rod assembly in adaptation to the positioning of the anchoring element to be envisaged.

In order to obtain a simple reduction of the external dimensions of the expanded anchoring element at an optionally required continuation of the drilling operation for increasing the length of the borehole so as to prevent excessive frictional forces from being introduced into the inner wall of the borehole through the anchoring element during the continued drilling operation, it is proposed according to a further preferred embodiment that the anchoring element, at least in its end region facing the drill bit, is formed by a material with memory effect, which is biased towards a reduction of the external dimension. After the removal of the expansion element from the anchoring element, the anchoring element will at least partially, or in its portion facing the drill bit, substantially return to its original external dimensions so as to allow for the reliable introduction of the anchoring element even during the continued drilling operation.

In order to avoid, during the drilling operation, the introduction of excessive frictional forces acting against the drilling operation through the anchoring element, which at least partially has a larger outer periphery or larger external dimension than the drill bit, it is proposed according to a further preferred embodiment that the external dimension of the anchoring element, during the drilling operation, exceeds the outer periphery of the drill bit by a maximum of 10 percent, preferably about 3 to 5 percent.

SHORT DESCRIPTION OF THE DRAWINGS

In the following, the invention will be explained in more detail by way of exemplary embodiments schematically illustrated in the accompanying drawing. Therein:

DETAILED DESCRIPTION OF PREFERRED EMBODIMENTS

Figure 1:
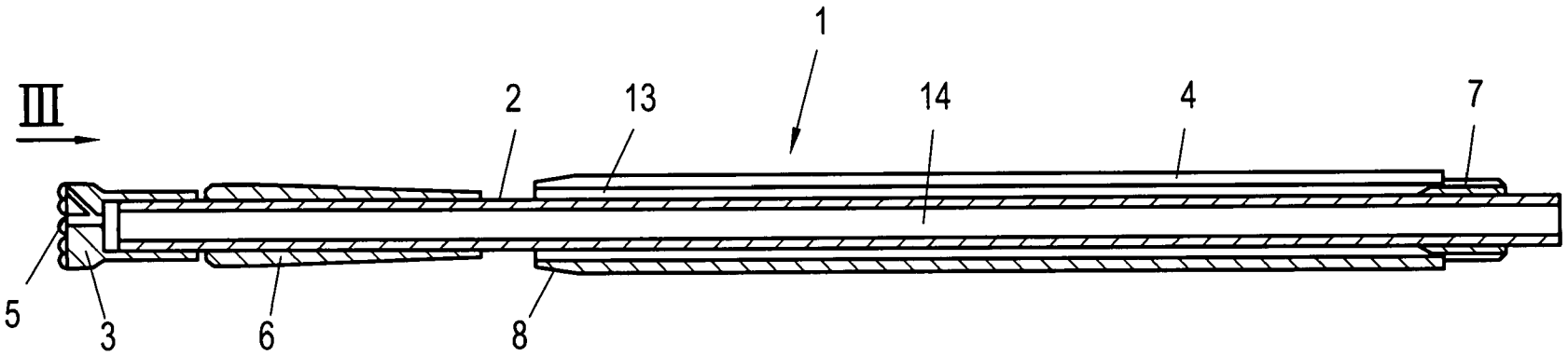
FIG. 1 depicts a schematic partial section through a first embodiment of a device according to the invention for carrying out the method of the invention, during the drilling operation.
Figure 2:
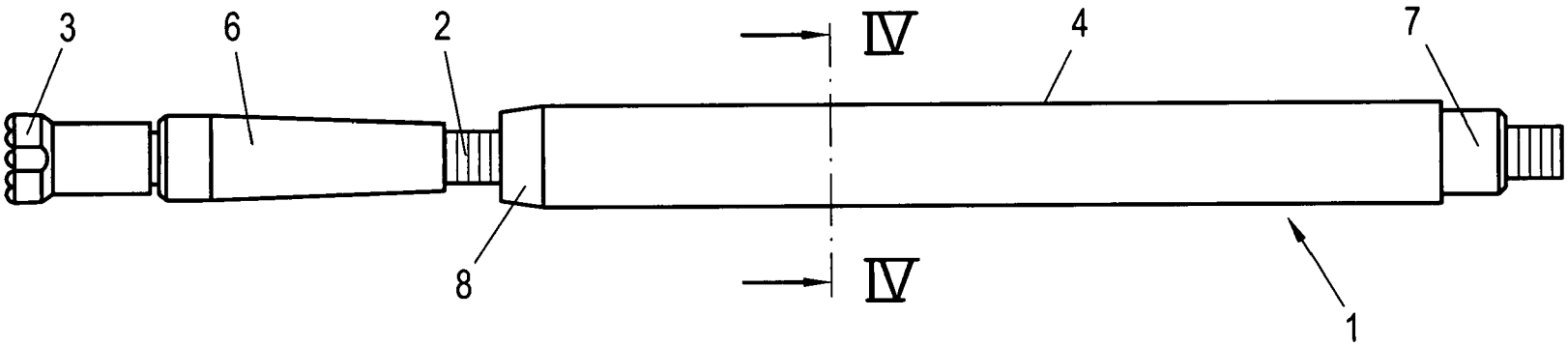
FIG. 2 is a side view of the embodiment according to FIG. 1.

In FIGS. 1 and 2, a device for producing a borehole (not illustrated in detail) is generally denoted by 1, wherein, on a particularly hollowly designed drill rod assembly 2, a drill bit 3 is mounted, which is driven to a rotational and/or percussive movement for the production of a borehole (not illustrated in detail) by a drive means (not illustrated in detail) contacting the end of the drill rod assembly 2 projecting out of the borehole.

Figure 4:
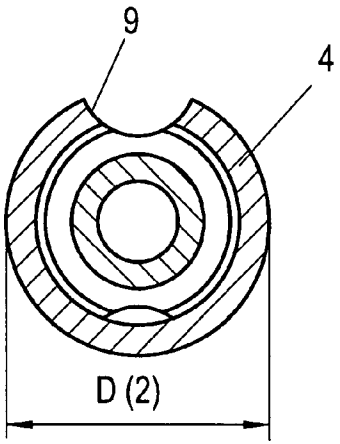
FIG. 4 is a section along line IV-IV of FIG. 2.
Figure 3:
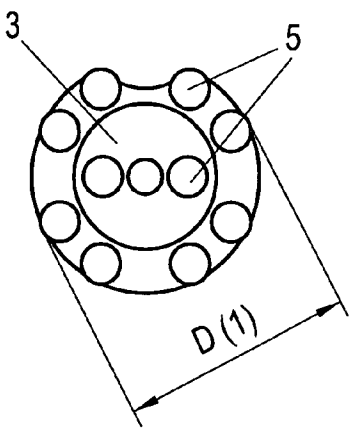
FIG. 3 is a front view of the drill bit along arrow III of FIG. 1.

At a distance from the drill bit 3 is provided an anchoring element 4 whose outer periphery or outer diameter slightly exceeds that of the drill bit 3, as is apparent from FIGS. 3 and 4, wherein it is shown that the diameter D(1) of the drill bit 3 is smaller than the diameter D(2) of the anchoring element 4.

On the end facing away from the working surface 5 of the drill bit 3, an expansion element 6 is, moreover, mounted on the drill rod assembly 2 between the drill bit 3 and the anchoring element 4, said expansion element having a cross section tapering or decreasing towards the anchoring element 4.

It is, moreover, apparent that, on the end of the anchoring element 4 facing away from the drill bit, a stop comprised, for instance, of a ring 7 is provided on the drill rod assembly 2 to receive the anchoring element 4 in abutment thereon.

For a reliable introduction of the anchoring element 4 during the drilling operation, the anchoring element 4, on its end facing the drill bit 3, comprises a bevel or taper 8 to enable its simple introduction during the frictional engagement on the inner wall of the borehole.

From FIG. 4, it is further apparent that the cylindrical or pipe-shaped anchoring element 4 comprises a slot 9 extending in the longitudinal direction to prevent the introduction of an excessive frictional force as a function of the dimensions of the inner wall of the borehole.

In order not to have to overcome excessive frictional forces during the introduction of the anchoring element 4, it is, moreover, apparent that the external dimension of the anchoring element 4 exceeds the outer periphery of the drill bit 3 by a maximum of 10 percent, for instance about 5 percent, during the drilling operation, as is illustrated in FIGS. 3 and 4.

Figure 5:
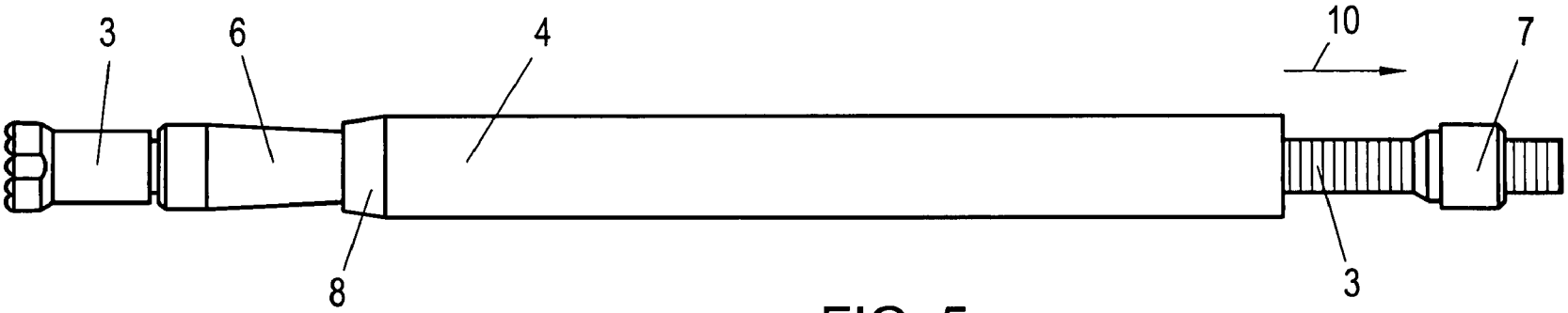
FIG. 5 is a side view of the embodiment according to FIGS. 1 and 2, with the drill rod assembly being retracted for the at least partial expansion of the anchoring element.
Figure 6:
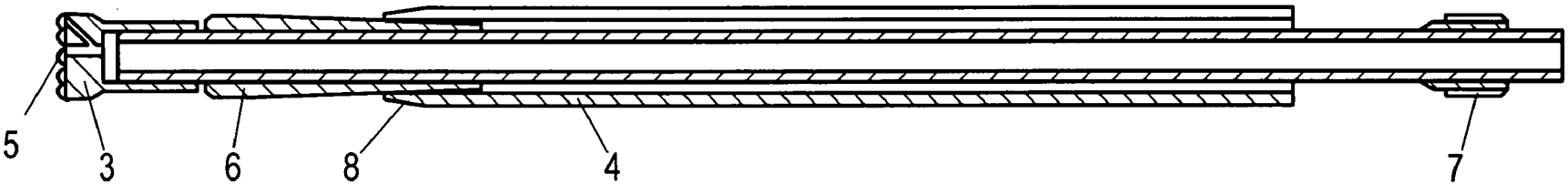
FIG. 6 is a sectional view through the embodiment according to FIG. 5.

FIGS. 5 and 6 illustrate how the drill rod assembly 2 and the drill bit 3, together with the expansion element 6, are retracted in the direction to the anchoring element 4 in the sense of arrow 10, opposite to the drilling direction, after the completion of a drilling operation, whereby, upon entry of the expansion element 6 conically widening towards the drill bit 3, the anchoring element 4 is accordingly widened on its end facing the drill bit 3 and brought into an additionally secured position on the borehole wall.

If it is detected, by the aid of a device known per se and not illustrated in detail, which is fixed to the end of the drill rod assembly 2 projecting out of the borehole in the manner of a clamping nut, that the anchoring performance or effect of the at least partially expanded anchoring element 4 decreases, for instance, on account of rock shifts or the like, it will be feasible in a simple manner, by newly acting upon the end of the drill rod assembly 2 projecting out of the borehole, to simply remove the expansion element from the anchoring element 4 in a sense opposite to the arrow 10 of FIG. 5, and continue the drilling operation accordingly via the drill bit 3.

After having obtained a greater borehole length, the expansion element 6 is again retracted into the anchoring element 4 together with the drill bit 3, wherein it is feasible, for instance, in order to increase the securing or anchoring effect, to introduce or retract the expansion element 6 more deeply into the anchoring element 4, beyond the state illustrated in FIGS. 5 and 6, so as to enable an accordingly greater expansion of the outer periphery of the anchoring element 4 in order to achieve an elevated anchoring effect.

Figure 7:
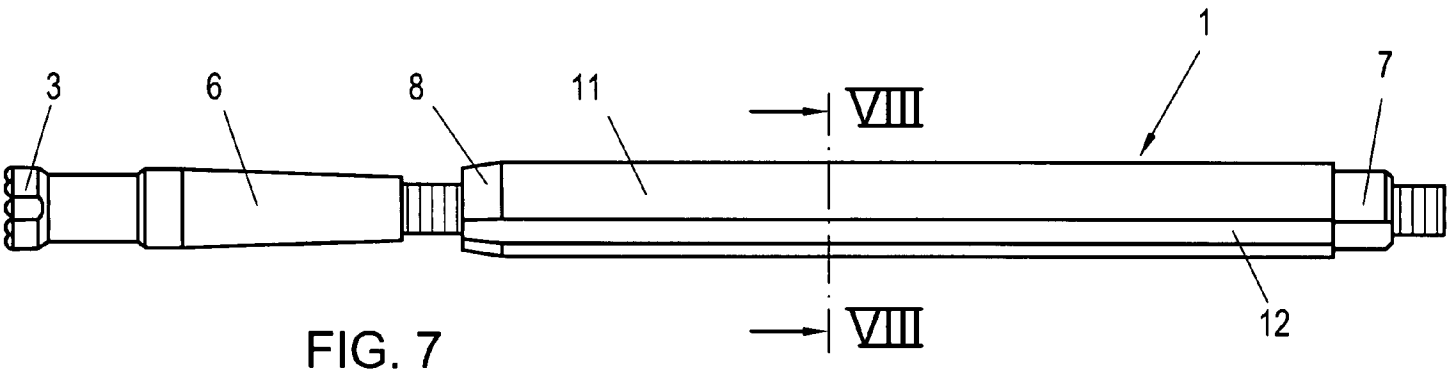
FIG. 7 is a side view in accordance with FIG. 2, of a modified configuration of a device according to the invention for carrying out the method of the invention.
Figure 8:
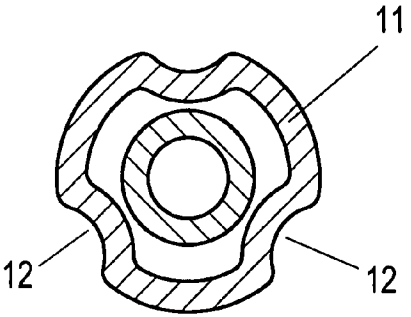
FIG. 8 is a section along line VIII-VIII of FIG. 7.

The device 1 illustrated in FIGS. 7 and 8 uses an anchoring element denoted by 11, which, contrary to the embodiment according to FIGS. 1 to 6, is not provided with a longitudinal slot, but comprises, on its outer periphery, portions of reduced diameter or reduced dimension 12, which will again prevent excessive frictional forces from acting during the drilling operation. Also in this embodiment, the portions of the anchoring element 11 differing from the portions 12 are designed to have larger diameters or larger external dimensions than the drill bit 3.

As in the preceding embodiment, the drill bit 3 and the expansion element, which is again denoted by 6, after the completion of the borehole, are retracted into the end of the anchoring element 11 facing the drill bit 3 and again designed with a bevel 8, in order to expand the anchoring element 11 and to obtain an accordingly enhanced anchoring effect. For the positioning of the anchoring element 11, an annular stop 7 is again provided in the embodiment according to FIG. 7.

To further promote the reduction of the outer diameter or external dimensions of the anchoring element 4 or 11, respectively, particularly during continued drilling for obtaining a greater borehole length, it is, moreover, feasible to use a material with memory effect, at least in the portion facing the drill bit 3, in order to obtain accordingly reduced outer dimensions after the extension of the expansion element 6, so as to prevent excessive frictional forces from occurring during the continued drilling operation.

The lengths of the anchoring elements 4 and 11, respectively, as well as their distances from the drill bit 3 and the expansion element 6 can be chosen as a function of the respective conditions by using the stop 7. It is further apparent from the above descriptions that excavated material can be readily removed through the hollow or annular space 13 formed between the anchoring element 4 or 11, respectively, and the outer periphery of the drill rod assembly 2, into a zone behind the anchoring element 4 or 11, respectively, to which end appropriate passage openings are also provided in the region of the stop 7.

When using a hollow drill rod assembly 2, it is, furthermore, feasible, in a manner known per se, to introduce a cooling or flushing fluid into the zone of the drill bit 3. Such a central channel 14 provided in the drill rod assembly 2 will further enable the introduction of a curable mass, in particular, after the final completion of the borehole, if required, especially into the region of the drill bit 3 as well as the anchoring element 4 or 11, respectively, to further enhance the anchoring effect.

The invention claimed is:

1. A method for drilling a borehole in soil or rock material and fixing an anchorage in said borehole, said method comprising the steps of forming a borehole by a drill bit mounted on a drill rod assembly, simultaneously introducing an anchoring element with the drill bit into the borehole and with the anchoring element surrounding the drill rod assembly so that the anchoring element is in the borehole in a frictionally engaged manner due to a widest diameter of the drill bit being less than a diameter of an entire length of the anchoring element, and first expanding the anchoring element to temporarily anchor the drill rod assembly and after further drilling and movement of the drill rod assembly expanding the anchoring element beyond the first expansion of the anchoring element after completion of the borehole.

2. The method according to claim 1, wherein the drill rod assembly is retracted in a direction towards the anchoring element after the completion of the borehole, and the anchoring element is expanded by an expansion element mounted on the drill rod assembly on a side of the drill bit facing away from a working surface.

3. The method according to claim 1, wherein a strength or resistance of the anchoring element is checked after the expansion of the anchoring element.

4. The method according to claim 3, wherein, during or after detection of a reduced resistance of the anchoring element, the drill rod assembly is again powered up for drilling to enlarge a length of the borehole.

5. A device for drilling a borehole in soil or rock material and fixing an anchorage in said borehole, said device comprising a drill bit mounted on a drill rod assembly, the drill rod assembly, on a rear side facing away from a working surface of the drill bit and, at a distance from the drill bit, being surrounded by an anchoring element, an external dimension of an entire length of the anchoring element at least partially exceeds a widest diameter of the drill bit so that as the drill bit forms the borehole, the anchoring element being simultaneously introduced with the drill bit and the drill rod assembly in the borehole in a frictionally engaged manner with respect to the borehole, the anchoring element being formed by one of a pipe which is slotted in a longitudinal direction along an entire length of the anchoring element or by a pipe having portions of reduced outer periphery so that the anchoring element is first expanded to temporarily anchor the drill rod assembly and after further drilling and movement of the drill rod assembly the anchoring element is expanded beyond the first expansion of the anchoring element.

6. The device according to claim 5, wherein the anchoring element is formed with a bevel on an end facing the drill bit.

7. The device according to claim 5, wherein, on the rear side facing away from the working surface of the drill bit, an expansion element tapering from the drill bit towards the anchoring element is provided, which is introduced into the expandable anchoring element after completion of the borehole, by a retraction of the drill rod assembly from the borehole.

8. The device according to claim 5, wherein a stop fixed to the drill rod assembly is provided on the end of the anchoring element facing away from the drill bit.

9. The device according to claim 5, wherein the anchoring element, at least in an end region facing the drill bit, is formed by a material with memory effect, which is biased towards a reduction of the external dimension.

10. The device according to claim 5, wherein the external dimension of the anchoring element, during the drilling operation, exceeds an outer periphery of the drill bit by a maximum of 10 percent.

* * * * *